US005661975A

United States Patent [19]

Abel et al.

[11] Patent Number: 5,661,975

[45] Date of Patent: Sep. 2, 1997

[54] SOOT FILTRATION DEVICE

[75] Inventors: Friedrich Abel, Eberdingen; Hans Erdmannsdoerfer, Dobel, both of Germany

[73] Assignee: Filterwerk Mann & Hummel GmbH, Ludwigsburg, Germany

[21] Appl. No.: 441,655

[22] Filed: May 15, 1995

[30] Foreign Application Priority Data

May 14, 1994 [DE] Germany ..... 44 17 044.0

[51] Int. Cl.[6] ..... F01N 3/02

[52] U.S. Cl. ..... 60/288; 55/466; 55/DIG. 30

[58] Field of Search ..... 60/286, 322, 323, 60/288; 55/466, DIG. 30

[56] References Cited

U.S. PATENT DOCUMENTS

| | | | |
|---|---|---|---|
| 3,649,215 | 3/1972 | Perga et al. . | |
| 4,251,487 | 2/1981 | Goedicke . | |
| 4,494,375 | 1/1985 | Rao et al. . | |
| 4,535,588 | 8/1985 | Sato | 60/297 |
| 4,730,455 | 3/1988 | Pischinger | 60/288 |
| 5,085,049 | 2/1992 | Rim | 60/288 |
| 5,293,742 | 3/1994 | Gillingham | 60/288 |

FOREIGN PATENT DOCUMENTS

| | | |
|---|---|---|
| 2655750 | 6/1978 | Germany . |
| 8701816 | 5/1987 | Germany . |
| 3832987 | 5/1989 | Germany . |
| 3829448 | 3/1990 | Germany . |
| 4100367 | 7/1992 | Germany . |
| 2134409 | 8/1984 | United Kingdom . |
| WO93/00503 | 3/1993 | WIPO . |

*Primary Examiner*—Douglas Hart
*Attorney, Agent, or Firm*—Evenson, McKeown, Edwards & Lenahan P.L.L.C.

[57] ABSTRACT

A soot filtration device (1) in the exhaust gas section of a diesel internal-combustion engine comprises a housing with an exhaust gas inlet (2) and an outlet (3) for the filtered exhaust gas, a plurality of soot filter cartridges (4) arranged in the housing, and at least one regeneration apparatus (5). The soot filter cartridges (4) are arranged in at least two separate chambers (6), and each of these chambers (6) has a closable inlet opening (7).

5 Claims, 3 Drawing Sheets

SOOT FILTRATION DEVICE

BACKGROUND OF THE INVENTION

This invention relates to a soot filtration device in the exhaust gas section of a diesel internal-combustion engine, comprising a housing with an exhaust gas inlet and an outlet for the filtered exhaust gas, a plurality of soot filter cartridges arranged in the housing and at least one regeneration apparatus.

Soot filtration devices of this type are known, for example, from Zachmann et al., published German Patent Application No. DE 3,725,587. These devices have the disadvantage that they must be attached in a not very space-saving and high-cost manner at different points of the overall system to be operated. Furthermore, this type of system results in an increase in the overall surface of the soot filtration device, which leads to increased heat radiation. However, in the regeneration stage a heat loss is counter-productive and the required energy consumption becomes excessive.

SUMMARY OF THE INVENTION

It is therefore an object of the invention to provide an improved soot filtration device.

Another object of the invention is to provide a soot filtration device which is simple to mount.

A further object of the invention is to provide a soot filtration device which can be operated easily, safely and economically.

These and other objects are achieved in accordance with the present invention by providing a soot filtration device in which a plurality of soot filter cartridges are arranged in at least two separate chambers and each of these chambers has a closable inlet opening.

An advantageous further embodiment provides that the inlet openings can be closed by means of alternately operable flaps which are jointly connected with a control apparatus. This is particularly useful for a disturbance-free filter and regeneration operation.

Furthermore, it may advantageously be provided that the flaps are arranged in an antechamber of the housing. This further preferred embodiment provides a reliable and tight closure of the flaps.

Another advantageous further preferred embodiment provides that the housing has an essentially cylindrical construction and is divided in its center by means of a partition, the partition being fastened to the housing without stress. This provides an optimal ratio of the volume to the surface. A specifically smaller surface results in lower heat losses and in a reliable and economical regeneration phase. The unstressed partition increases the component safety and the secure operation of the device.

Furthermore, it may be provided that a burner for generating regeneration heat is attached via a flange directly to the housing in the area of the antechamber. Shortened flow paths reduce the heat losses and ensure a reliable and economical regeneration operation.

An advantageous further embodiment provides that a burner is arranged on each of the respective chambers which enclose the soot filter cartridges.

These and other features of preferred embodiments of the invention, in addition to being set forth in the claims, are also disclosed in the specification and/or the drawings, and the individual features each may be implemented in embodiments of the invention either individually or in the form of subcombinations of two or more features and can be applied to other fields of use and may constitute advantageous, separately protectable constructions for which protection is also claimed.

BRIEF DESCRIPTION OF THE DRAWINGS

The invention will be described in further detail hereinafter with reference to illustrative preferred embodiments shown in the accompanying drawings in which.

DETAILED DESCRIPTION OF PREFERRED EMBODIMENTS

Figure 1:
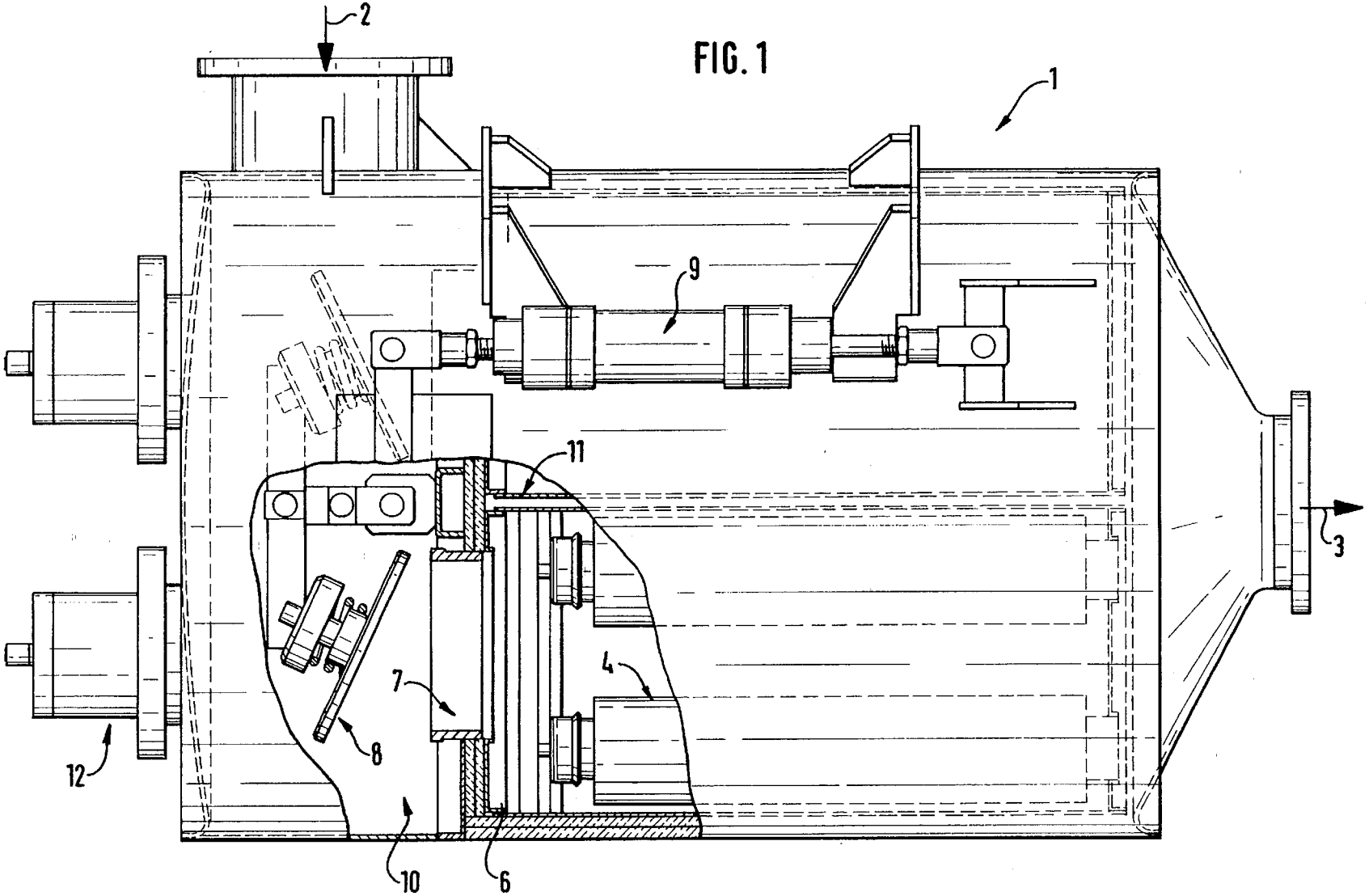
FIG. 1 is a view of a soot filtration device according to the invention.
Figure 2:
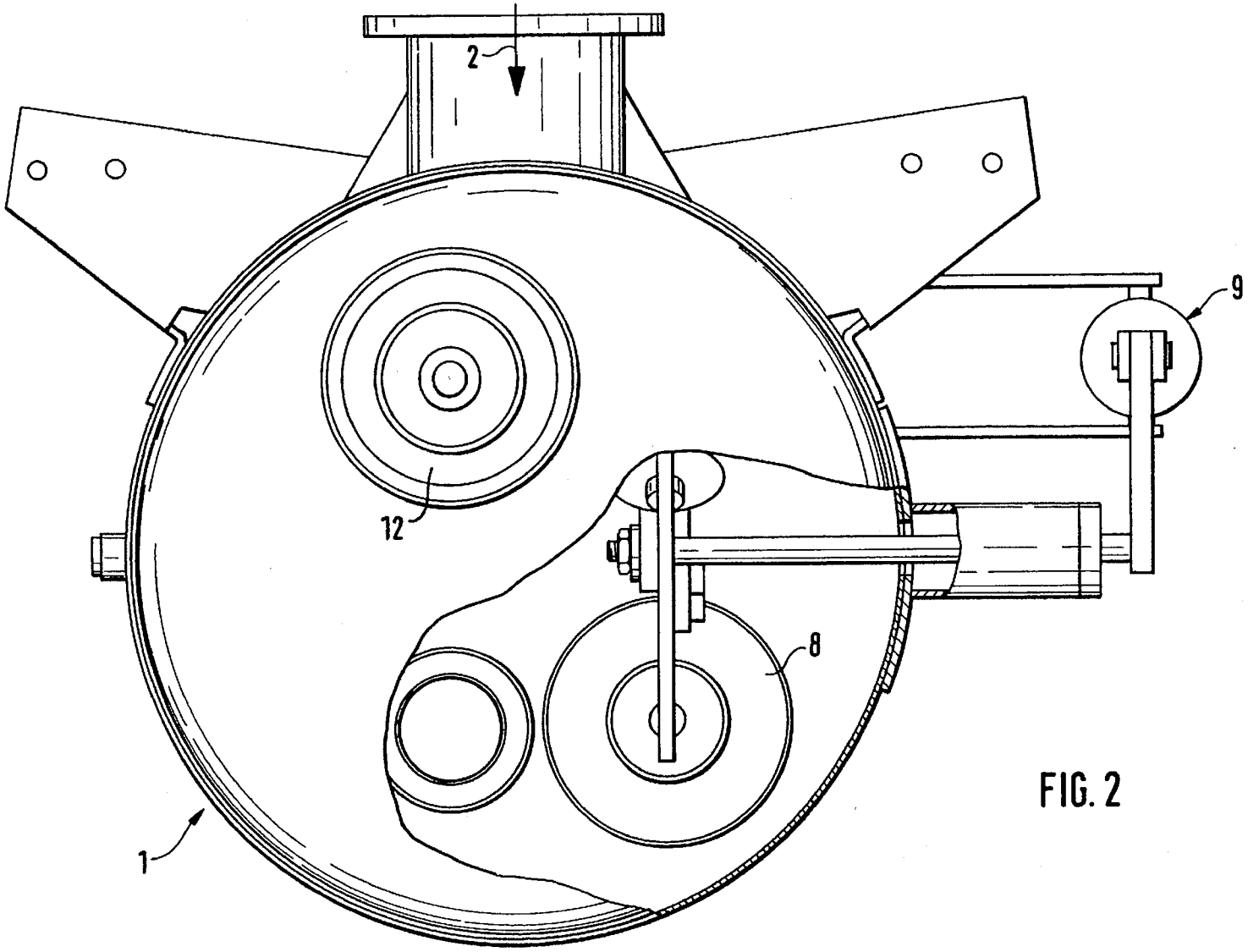
FIG. 2 is a top view of the soot filtration device of FIG. 1.
Figure 3:
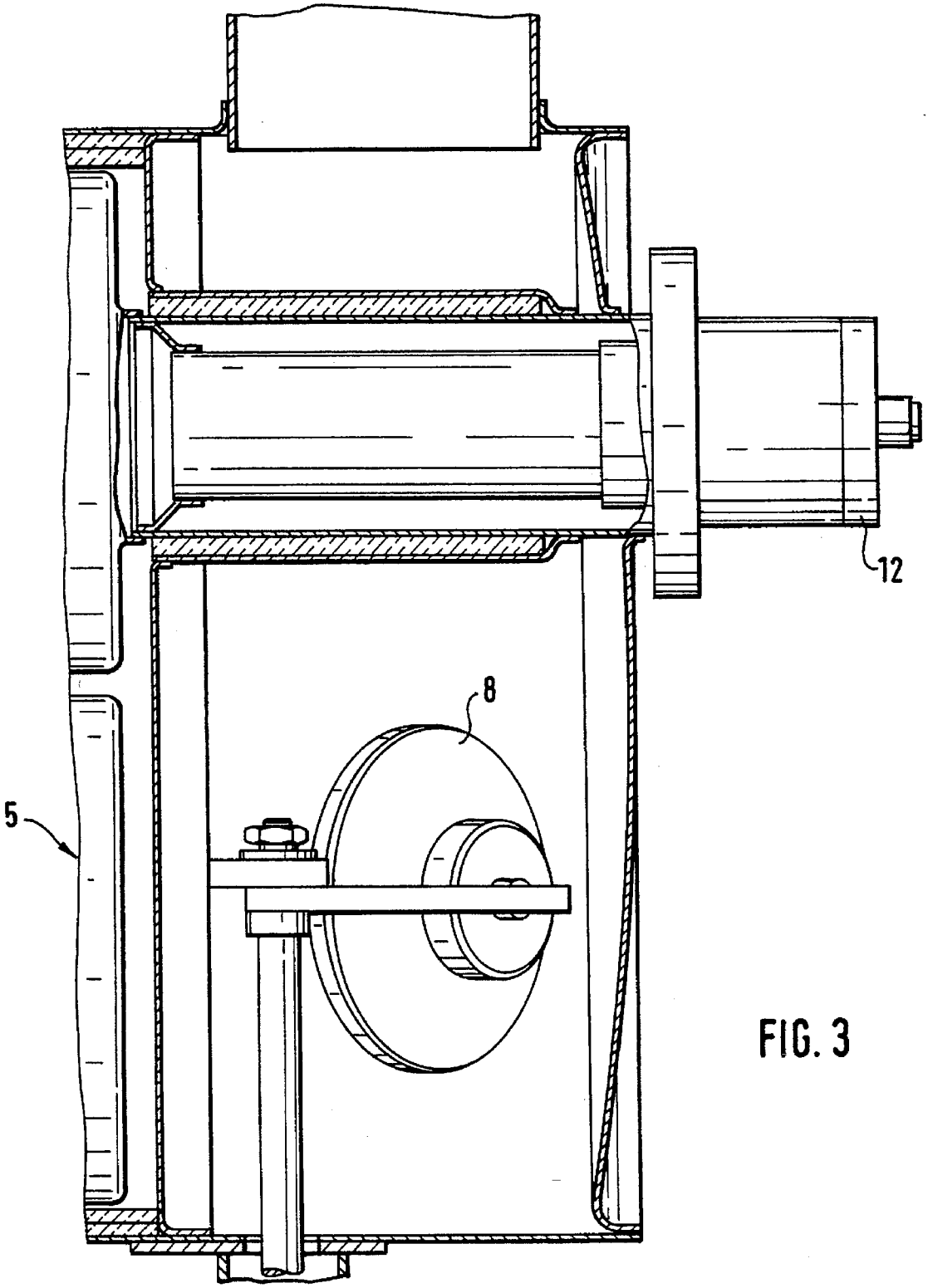
FIG. 3 is a view of the regeneration apparatus.

The soot filtration device 1 in the exhaust gas section of a diesel internal-combustion engine comprises a housing with an exhaust gas inlet 2 and an outlet 3 for the filtered exhaust gas, a plurality of soot filter cartridges 4 arranged in the housing, at least one regeneration apparatus 5 and soot filter cartridges 4 arranged in two separate chambers 6. Each of these chambers has a closable inlet opening 7. The inlet openings 7 can be closed by means of alternately operable covers which are jointly connected via a lever mechanism to a control device 9, such as a hydraulic or pneumatic cylinder. The covers 8 are arranged in a antechamber 10 of the housing. In the illustrated embodiment the lever mechanism is such that when one of the covers 8 is closed, the other cover will be open. The housing is cylindrical and is divided in its approximate center by a partition 11. The partition is fastened to the housing without stress. A burner 12 for generating the regeneration heat is attached via a flange directly to the housing in the area of the antechamber 10. In the illustrated embodiment, a burner 12 is arranged on each chamber 6 enclosing the soot filter cartridges 4. The connection between the burner 12 and the associated regeneration unit is seen more clearly in FIG. 3. In operation, when soot accumulates in the filter cartridges 4 in one of the chambers 2, the soot-fouled filter cartridges can be regenerated by actuating the control device 9 to close the cover 8 over the inlet 7 to that one chamber and igniting the burner 12 associated with that chamber, while exhaust gases from the diesel engine continue to be filtered by passing them through the open inlet 7 of the other chamber 2 and through the filter cartridges 4 in the other chamber. When the filter cartridges 4 in the one chamber have been regenerated by burning off the soot and soot has accumulated in the filter cartridges of the other chamber, the operation can be reversed.

The foregoing description and examples have been set forth merely to illustrate the invention and are not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A soot filtration device for exhaust gas from a diesel internal-combustion engine, said device comprising a housing with an exhaust gas inlet and an outlet for filtered exhaust gas, a plurality of soot filter cartridges arranged in the housing, and at least one regeneration apparatus, wherein the soot filter cartridges are arranged in at least two separate chambers, and each of said chambers has a closable inlet opening, the inlet openings being closable by means of alternately operable covers mounted respectively on opposite ends of a rocker lever such that when one of the inlet openings is closed by one of the covers, the other inlet opening is open, said covers being jointly operated by a common control mechanism connected to the rocker lever.

2. A soot filtration device according to claim 1, wherein the rocker lever and covers are arranged in an antechamber of the housing.

3. A soot filtration device according to claim 2, wherein a burner for generating regeneration heat is attached directly to the housing in the vicinity of the antechamber.

4. A soot filtration device according to claim 2, wherein a burner is arranged on each of the chambers which enclose the soot filter cartridges.

5. A soot filtration device according to claim 1, wherein the housing has an essentially cylindrical construction and is divided centrally by a partition, said partition being fastened to the housing.

* * * * *